US012692565B2

(12) United States Patent
Yu et al.

(10) Patent No.: US 12,692,565 B2
(45) Date of Patent: Jul. 28, 2026

(54) SELF-ADAPTIVE HANGING STRUCTURE OF CONVERTER

(71) Applicant: CISDI Engineering Co., Ltd., Chongqing (CN)

(72) Inventors: Yang Yu, Chongqing (CN); Qing Wang, Chongqing (CN); Ming Zeng, Chongqing (CN)

( * ) Notice: Subject to any disclaimer, the term of this patent is extended or adjusted under 35 U.S.C. 154(b) by 207 days.

(21) Appl. No.: 18/272,585

(22) PCT Filed: Mar. 23, 2022

(86) PCT No.: PCT/CN2022/082423

§ 371 (c)(1),
(2) Date: Dec. 18, 2023

(87) PCT Pub. No.: WO2022/262348

PCT Pub. Date: Dec. 22, 2022

(65) Prior Publication Data

US 2024/0318270 A1 Sep. 26, 2024

(30) Foreign Application Priority Data

Jun. 16, 2021 (CN) ..... 202121337790.4

(51) Int. Cl.
*C21C 5/46* (2006.01)

(52) U.S. Cl.
CPC ..... *C21C 5/4633* (2013.01)

(58) Field of Classification Search
CPC ..... C21C 5/4633; C21C 5/50; C21C 5/4646; C21C 5/464; F27B 3/065; F27B 7/22
(Continued)

(56) References Cited

U.S. PATENT DOCUMENTS 5,364,079 A * 11/1994 Gruber ..... C21C 5/4633 266/245
6,228,320 B1 * 5/2001 Nagati ..... C21C 5/50 266/245
9,358,610 B2 * 6/2016 Joo ..... F27B 14/02

FOREIGN PATENT DOCUMENTS

CN 102776318 A * 11/2012 ..... C21C 5/46
CN 104313237 B * 4/2016 ..... C21C 5/46
CN 105710550 * 6/2016 ..... C21C 5/46

OTHER PUBLICATIONS

CN105710550, Liao et al. A Large Converter Five-bar Linkage Suspension Device For Assembling And Welding Method,Jun. 29, 2016 (Year: 2016).*

(Continued)

*Primary Examiner* — Jessee R Roe
*Assistant Examiner* — Michael Aboagye
(74) *Attorney, Agent, or Firm* — Michael D. Eisenberg; MDE Patents

(57) ABSTRACT

The invention discloses a self-adaptive hanging structure of a converter, including vertical connecting rod mechanisms connecting the lower edge of a backing ring body and a lower half converter body of the converter, and horizontal connecting rod mechanisms connecting the upper edge of the backing ring body and an upper half converter body of the converter; the horizontal connecting rod mechanisms are located above the vertical connecting rod mechanisms, the plane where the axis of a trunnion on the backing ring body and the axis of the backing ring body are located serves as the first reference plane, the symmetric center of each vertical connecting rod mechanisms is located in the radiation area of the first included angle, the two planes forming the first included angle coincide with the axis of the backing ring body, and the included angles being 15 degrees and 50 degrees are formed between the two planes and the first (Continued)

reference plane respectively. The invention makes the converter tilting without abnormal noise and running stably, which not only eliminates the super-static over-constraining problem, but also facilitates the converter suspension connecting rod mechanism to adapt to the working conditions, improves the service life of the hanging mechanism, makes the equipment long-term maintenance-free, realizes the main parts interchanging of the connecting rod mechanism, reduces equipment spare parts and equipment maintenance workload.

8 Claims, 5 Drawing Sheets

(58) Field of Classification Search
USPC ..... 266/242–248
See application file for complete search history.

(56) References Cited

OTHER PUBLICATIONS

Office Action of Corresponding CN application 202121337790.4, published on Mar. 22, 2022.
Notice of Grant of Patent Right of corresponding CN Application 202121337790.4, published on Apr. 18, 2022.
The grant claims of corresponding CN application 202121337790.4.

* cited by examiner

SELF-ADAPTIVE HANGING STRUCTURE OF CONVERTER

TECHNICAL FIELD

The invention belongs to the technical field of metallurgy and relates to a self-adaptive hanging structure of a converter.

BACKGROUND

The suspension system is one of the key components of the converter. In practice, the support of the furnace body is achieved by positioning the backing ring in the suspension system outside the furnace body through different types of suspension structure. During operation, the tilting moment is applied to the trunnion of the backing ring, so that the moment is transferred from the backing ring to the furnace body. At the same time, the backing ring absorbs various stresses and morphological changes in the furnace body caused by temperature changes.

However, the technical difficulty of suspension support system under the converter is the horizontal support when the converter is in a non-vertical working attitude, especially the arrangement of the horizontal support structure in the connecting rod mechanism and converter operation, which has a direct impact on the equipment operation safety and operation quality (whether the converter tilting is smooth, there is no shock, vibration, wear and abnormal noise, and the safety of the converter equipment, etc.) when the converter tonnage is large, and the core technical idea of the horizontal support of the connecting rod mechanism is the number and the location of the connecting rod mechanisms on the converter equipment.

Theoretical analysis and practice prove that no matter what kind of hanging structure is used, during the tilting rotation of the converter, the huge braking inertia mechanical force caused by the forward and reverse rotation start and stop as well as the deformation of the equipment caused by the high thermal load make the "alternating misalignment displacement" between the furnace body and the backing ring body. This alternating misalignment displacement includes the "alternating misalignment" caused by the bending and twisting effect of the backing ring itself and the "alternating misalignment displacement" between the furnace body and the backing ring body due to the equipment structure, motion inertia and thermal expansion differences when the converter is tilted. Therefore, many hanging structures have certain adaptive deformation capacity to adapt to this alternating misalignment displacement.

In the patent ZL93117357.4 "Tilting converter", several connecting rod mechanisms are set between the lower part of the backing ring and the converter body, there are two types of connecting rod mechanism: vertical connecting rod mechanism and horizontal connecting rod mechanism. There are three groups of horizontal connecting rod mechanisms. In addition to setting the pendulum 6 or static guide mechanism 7 in the lower middle part of the backing ring of the converter, a horizontal pendulum is set at the weak part of the horizontal support of each side of the trunnion in the lower part of the backing ring of the converter. Practice proves that setting one horizontal pendulum at each side of the trunnion is not suitable for large tonnage converter. When the converter is in the vertical working attitude with the furnace mouth facing upward, the main force is concentrated on the vertical connecting rod mechanism, and the vertical connecting rod mechanism can act adaptively. While when the converter is in the non-vertical working attitude, the main force is concentrated on the horizontal connecting rod mechanism, and the horizontal connecting rod mechanism can also act adaptively depending on the force applied. However, the finite element analysis and practice prove that in this kind of converter, under the two attitudes of upright and inverted converter, the horizontal connecting rod mechanism is subjected to the most obvious bending and torsional effect in the installation part near the backing ring of the trunnion. The alternating misalignment in this part rises obviously during the whole tilting and rotating process of the converter, and the alternating misalignment is close to 7 mm~13 mm (the actual measurement data is up to 15 mm). Although the connecting rod mechanism itself can absorb part of the relative displacement through adaptive action, but because of the large amount of misalignment displacement and the misalignment displacement is the alternating misalignment impact displacement, the horizontal connecting rod mechanism difficultly absorb all the relative displacement, which not only affects the principle working condition of the horizontal connecting rod's diametrical rod applied by only the tensile pressure, but also the working life of the horizontal connecting rod mechanism. The practice proves that the horizontal support structure and its arrangement in this kind of tilting converter is the inherent defect in the design.

In the patent ZL201210291941.6 "Arrangement structure of a four-point connecting rod hanging device for a converter", there are four vertical connecting rod mechanisms set between the lower edge of the backing ring and the converter shell body, and a blocking seat mechanism is set between the upper edge of the backing ring and the converter shell body. The vertical connecting rod mechanism in this patent also has adaptive deformation ability, but as long as the converter is equipped with the blocking seat mechanism, no matter the blocking seat mechanism is arranged in any position of the converter, there will be alternating elastic slip between the furnace shell blocking seat and the support seat of the backing ring, which cause friction and wear. Also, the gap between the furnace shell blocking seat and the support seat of the backing ring is caused, and there will be strong impact and abnormal noise when the converter is strongly inertial forward and reverse braking, which even cause the blocking seat to fall off due to impact and bring equipment and personal safety hazards to the operation of the converter. Therefore, it is necessary to regularly maintain and replace the wear parts of the blocking seat device, which is the fundamental problem and difficult to be solved. Although the patent pointed out that a replaceable wear pad is set between the furnace shell blocking seat and the support seat of the backing ring, a connector is needed between the wear pad and the blocking seat or support seat. In the high temperature, dust and spattering and other harsh smelting operating conditions, to remove the connector and replace the wear pad in the narrow space between the blocking seat and the support seat is very difficult, because the connector in the high temperature, dust and spattering environment will deform, bond and seize. In this case, the connector cannot be disassembled, and it can only be cut and then replaced, which increases the maintenance cost and repair time of the equipment.

In addition, whether it is the way of pendulum 6 or static guiding mechanism 7 used in the patent ZL93117357.4 "Tilting converter" or the way of setting the guiding seat used to limit the movement of the converter shell along the axial direction of the trunnion disclosed in patent ZL201210291941.6 "Arrangement structure of a four-point connecting rod hanging device for a converter", the whole converter suspension support system not only become complex but also cause super static over constraint, which is not conducive to the self-adaptive working conditions of the converter suspension system, and will increase the equipment maintenance workload. In fact, the engineering application verification proves that it is not necessary.

INVENTION CONTENT

In view of this, the object of the present invention is to provide a self-adaptive hanging structure of a converter that optimizes the number and the location of connecting rod mechanisms on the converter equipment, which adapts to the working conditions of large-tonnage converters, improves the service life of the hanging structure, and reduces the equipment maintenance cost of the hanging structure.

To achieve the above purpose, the present invention provides the following technical solution:

A self-adaptive hanging structure of a converter includes vertical connecting rod mechanisms connecting the lower edge of a backing ring body and a lower half converter body of the converter, and horizontal connecting rod mechanisms connecting the upper edge of the backing ring body and an upper half converter body of the converter; the horizontal connecting rod mechanisms are located above the vertical connecting rod mechanisms, the plane where the axis of a trunnion on the backing ring body and the axis of the backing ring body are located serves as the first reference plane, the symmetric center of each vertical connecting rod mechanisms is in the radiation area located within the area defined by the first included angle, the two planes forming the first included angle coincide with the axis of the backing ring body, and the included angles being 15 degrees and 50 degrees are formed between the two planes and the first reference plane respectively.

Optionally, the center of symmetry of each vertical connecting rod mechanism is co-planar with the axis of the backing ring body.

Optionally, the horizontal connecting rod mechanism has a mounting position reference mark which is sector defined by the second included angle, the plane where the center of symmetry of the vertical connecting rod mechanism and the axis of the backing ring body are located serves as the second reference plane, the mounting position reference mark is sector defined by the second included angle, both planes forming the second included angle coincide with the axis of the backing ring body and form a included angle of −10 degree and 10 degree respectively with the second reference plane.

Optionally, the horizontal connecting rod mechanism includes a first connecting rod seat, a horizontal connecting rod and a second connecting rod seat; the first connecting rod seat sets on the upper half of the converter body, and the second connecting rod seat sets on the upper edge of the backing ring body; the horizontal connecting rod hinges to the first connecting rod seat and the second connecting rod seat respectively; the mounting position reference mark is on the horizontal connecting rod.

Optionally, the mounting position reference mark is at the center of the horizontal connecting rod.

Optionally, the mounting position reference mark is an identification hole set on the horizontal connecting rod.

Optionally, the vertical connecting rod mechanism comprises a third connecting rod seat, a vertical connecting rod and a fourth connecting rod seat; the third connecting rod seat sets on the lower half of the converter body, and the fourth connecting rod seat sets on the lower edge of the backing ring body; the third connecting rod seat and the fourth connecting rod seat are hinged to the vertical connecting rod respectively.

Optionally, the horizontal connecting rod in each horizontal connecting rod mechanism has the same shape and size as the vertical connecting rod in each vertical connecting rod mechanism.

Optionally, the first connecting rod seat and the second connecting rod seat are respectively rotatably connected to the horizontal connecting rod by means of a first joint bearing and a first articulated shaft, and the third connecting rod seat and the fourth connecting rod seat are respectively rotatably connected to the vertical connecting rod by means of a second joint bearing and a second articulated shaft; the first joint bearing and the second joint bearing have the same structure and size, and the first articulated shaft and the second articulated shaft have the same structure and size.

The beneficial effects in this invention is that in the actual work of the converter tilting, there is no abnormal noise with smooth running, the connecting rod mechanism does not need to adjust the work, which not only eliminates the problem of super static over constraint, but also facilitates the suspension connecting rod mechanism of the converter adaptive working conditions, thereby improving the service life of the hanging mechanism as well as the equipment long-term maintenance-free. The main parts of the horizontal and vertical connecting rod mechanism can be interchangeable, which reduces the variety of equipment spare parts and equipment maintenance workload.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF DRAWINGS

To clarify the objectives, technical solutions, and advantages of the present invention, the following detailed description is provided with reference to the accompanying drawings, wherein.

In the figures.

furnace body—1, backing ring—2, backing ring body—21, trunnion—22, vertical connecting rod mechanism—3, third connecting rod seat—31, vertical connecting rod—32, fourth connecting rod seat—33, second joint bearing—34, second articulated shaft—35, horizontal connecting rod mechanism—4, first connecting rod seat—41, horizontal connecting rod—42, second connecting rod seat—43, first joint bearing—44, first articulated shaft—45, mounting position reference mark—401.

DETAILED DESCRIPTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

Figure 1:
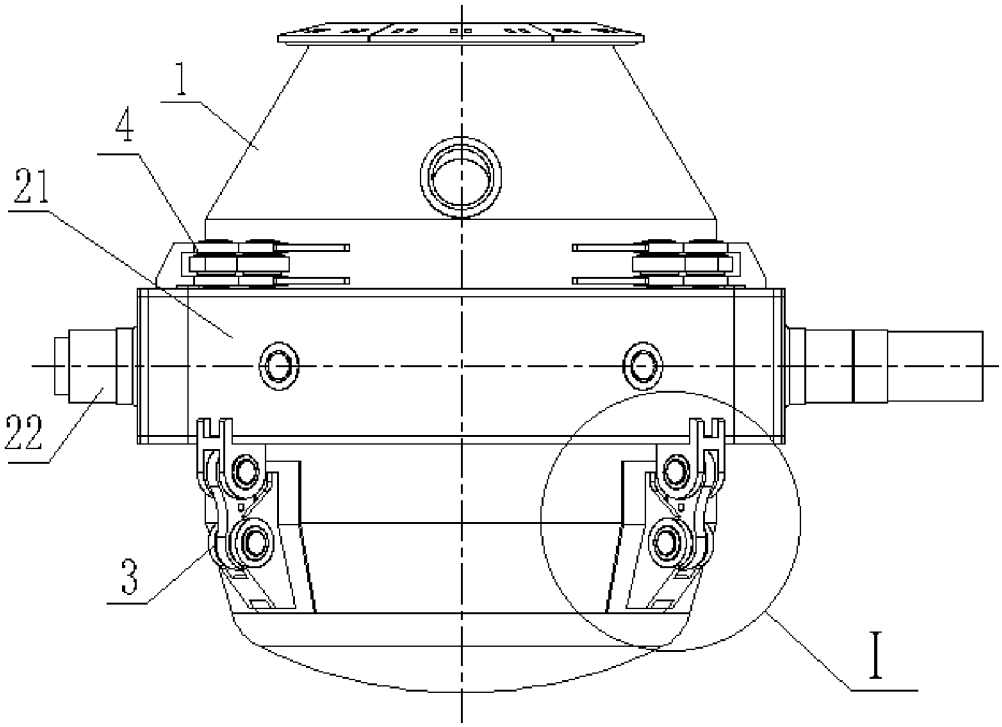
FIG. 1 is a schematic diagram of a self-adaptive hanging structure of a converter in the present invention.
Figure 2:
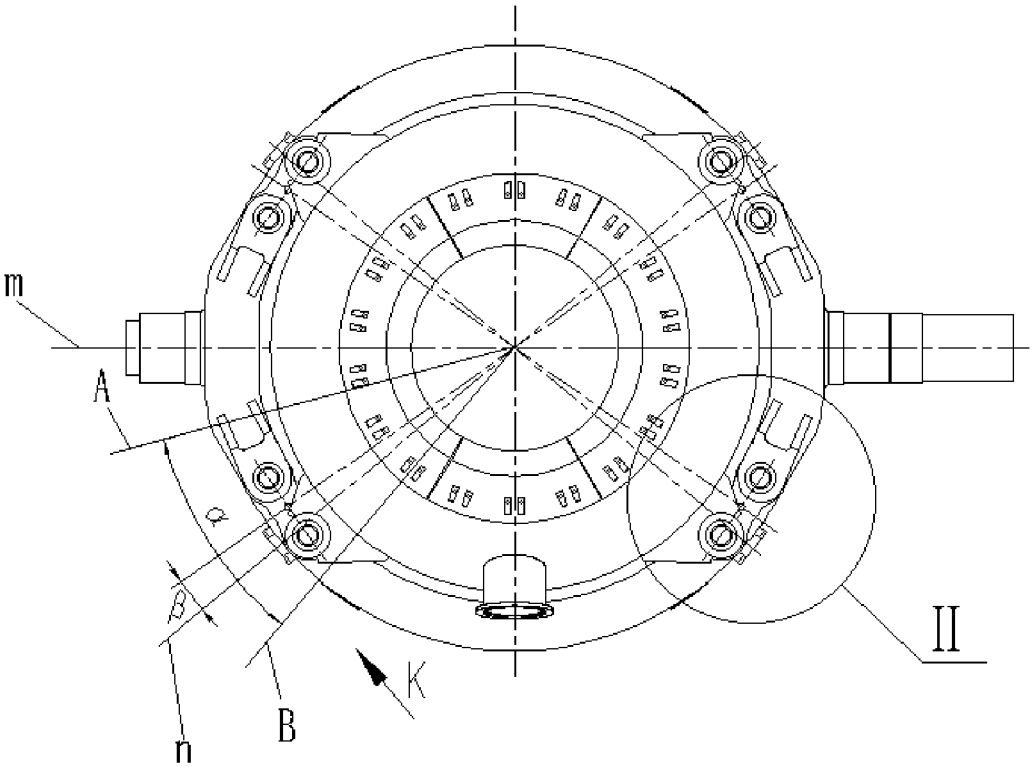
FIG. 2 is a top view of the self-adaptive hanging structure shown in FIG. 1.
Figure 3:
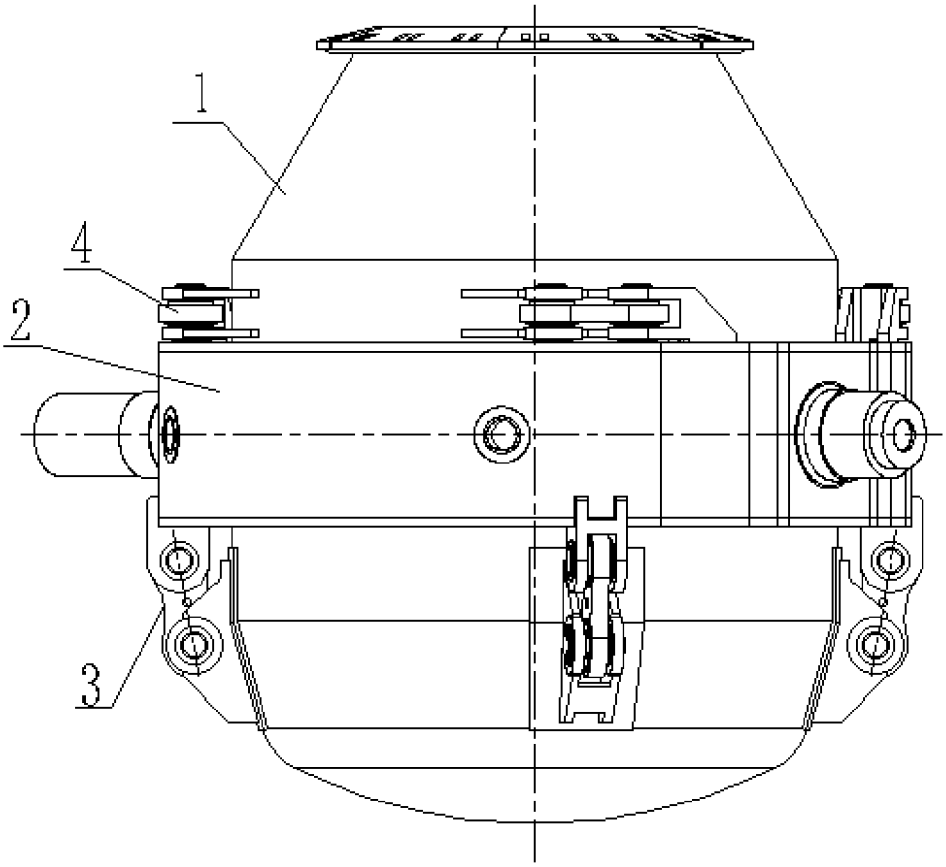
FIG. 3 is a side view of the self-adaptive hanging structure taken along the direction K in FIG. 2.

As illustrated in FIGS. 1 to 3, the converter includes a furnace body 1 and a backing ring 2. The backing ring 2 comprises a backing ring body 21 and a trunnion 22 disposed on the backing ring body 21. The self-adaptive hanging structure of the converter includes a vertical connecting rod mechanism 3 and a horizontal connecting rod mechanism 4.

The vertical connecting rod mechanism 3 is connected between a lower edge of the backing ring body 21 and a lower half of the furnace body 1. The horizontal connecting rod mechanism 4 is connected between an upper edge of the backing ring body 21 and an upper half of the furnace body 1. Each horizontal connecting rod mechanism 4 is positioned above a corresponding vertical connecting rod mechanism 3.

A plane defined by an axis of the trunnion 22 on the backing ring body 21 and an axis of the backing ring body 21 serves as a first reference place m. The center of symmetry of each group of vertical connecting rod mechanism 3 is located within a sector defined by a first included angle $\alpha$, wherein two planes forming the first included angle $\alpha$ both pass through the axis of the backing ring body 21. Among the two planes, a first plane A and the first reference plane m form a 15° included angle. The 15° included angle encompasses both clockwise and counter-clockwise orientations. For any given group of the vertical connecting rod mechanism 3, its first plane A and second plane B are located on the same side of the first reference plane m.

As used herein, the center of symmetry of the vertical connecting rod mechanism 3 substantially refers to a median plane n of the vertical connecting rod mechanism 3 itself. The description that the horizontal connecting rod mechanism 4 is correspondingly positioned above the vertical connecting rod mechanism 3 means that, when the furnace body 1 is in a vertical orientation, the horizontal connecting rod mechanism 4 is positioned either directly above the vertical connecting rod mechanism 3 or slightly offset from a position directly above the vertical connecting rod mechanism 3.

Referring to FIGS. 1 to 3, there are eight groups of connecting rod mechanisms in total, including four groups of horizontal connecting rod mechanisms 4 and four groups of vertical connecting rod mechanisms 3. In practical implementation, the number of connecting rod mechanisms may be determined based on the actual tonnage of the converter. For example, eight groups (consisting of four groups of vertical connecting rod mechanisms and four groups of horizontal connecting rod mechanisms), or even a greater number, may be arranged according to specific requirements.

In some embodiments as shown in FIG. 2, the center of symmetry of each group of connecting rod mechanisms 3 itself is coplanar with the axis of the backing ring body 21. In actual implementation, the center of symmetry of the vertical connecting rod mechanism 3 may also not be coplanar with the backing ring body 21, provided that it is located within the sector defined by the first included angle.

In some embodiments, the horizontal connecting rod mechanism 4 includes a mounting position reference mark 401 located within a sector defined by a second included angle. A plane defined by the axis of the backing ring body 21 and the median plane n serves as a second reference plane. The mounting position reference mark 401 is positioned within the sector defined by the second included angle, wherein two planes forming the second included angle both pass through the axis of the backing ring body 21 and form included angles of −10° and 10° with the second reference plane, respectively. That is, as illustrated in FIG. 2, the value $\beta$ ranges from greater than or equal to −10° to less than or equal to 10°. The positive and negative values of $\beta$ here respectively represent counterclockwise and clockwise.

This arrangement ensures that each horizontal connecting rod mechanism 4 is positioned above its corresponding vertical connecting rod mechanism 3 without excessive deviation, thereby ensuring that each pair of the horizontal and vertical connecting rod mechanisms 4, 3 forms a reliable and adaptive two-point support structure.

Figure 5:
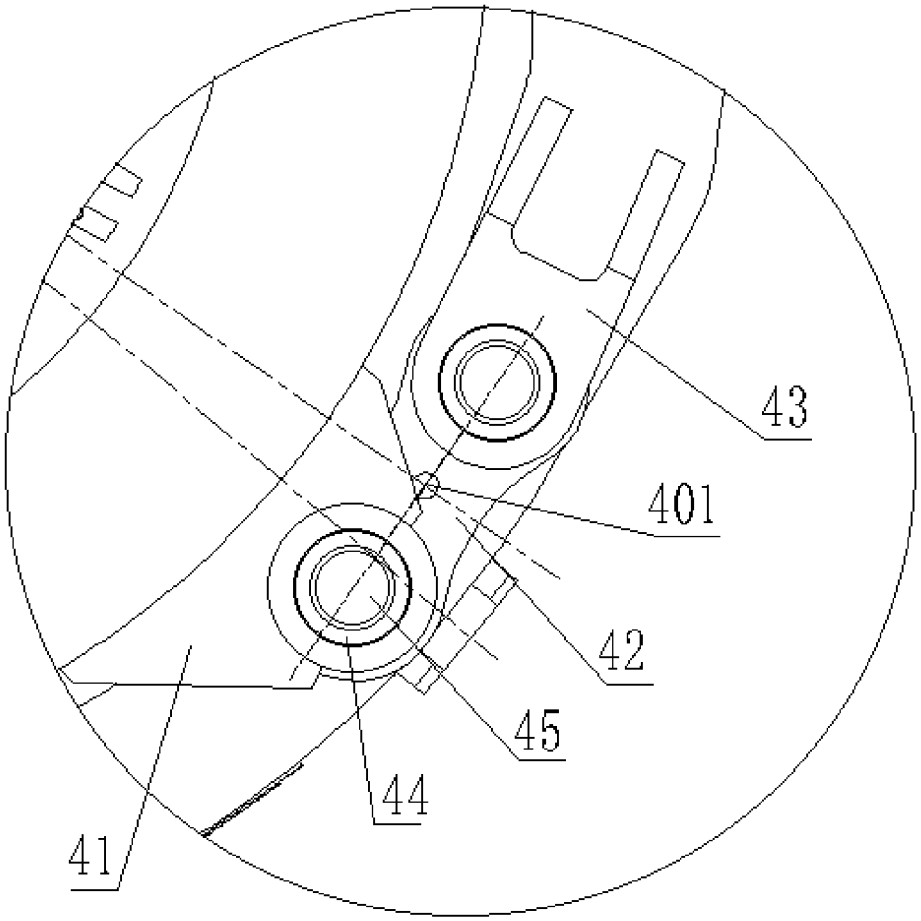
FIG. 5 is a partial enlarged view of the portion indicated by "II" in FIG. 2.

In some embodiments, the horizontal connecting rod mechanism 4 includes a first connecting rod seat 41, a horizontal connecting rod 42 and a second connecting rod seat 43, the first connecting rod seat 41 is set on the upper half of the furnace body 1, the second connecting rod seat 43 is set on the upper edge of the backing ring body 21, the horizontal connecting rod 42 is respectively hinged to the first connecting rod seat 41 and the second connecting rod seat 43, and the mounting position reference mark 401 is on the horizontal connecting rod 42. For example, as shown in FIG. 2 and FIG. 5, the mounting position reference mark 401 can be a marking hole set on the horizontal connecting rod 42. In the actual implementation, the horizontal connecting rod mechanism 4 is different from the vertical connecting rod mechanism 3 in structure, the horizontal connecting rod mechanism 4 itself may not adopt symmetrical structure. Therefore, there may not be a symmetrical center surface, and the horizontal connecting rod 42 of the horizontal connecting rod mechanism 4 is set horizontally at the specific setting position which is not easy to determine. The mounting position reference mark 401 is set on the horizontal connecting rod 42 to help control the horizontal The installation position reference mark 401 is set on the horizontal rod 42, which is helpful to control the arrangement position of the horizontal connecting rod mechanism 4 to ensure that the horizontal connecting rod mechanism 4 is in the area where the "alternating misalignment displacement" is small.

In some embodiments, the mounting position reference mark 401 is at the center of the horizontal connecting rod 42.

Figure 4:
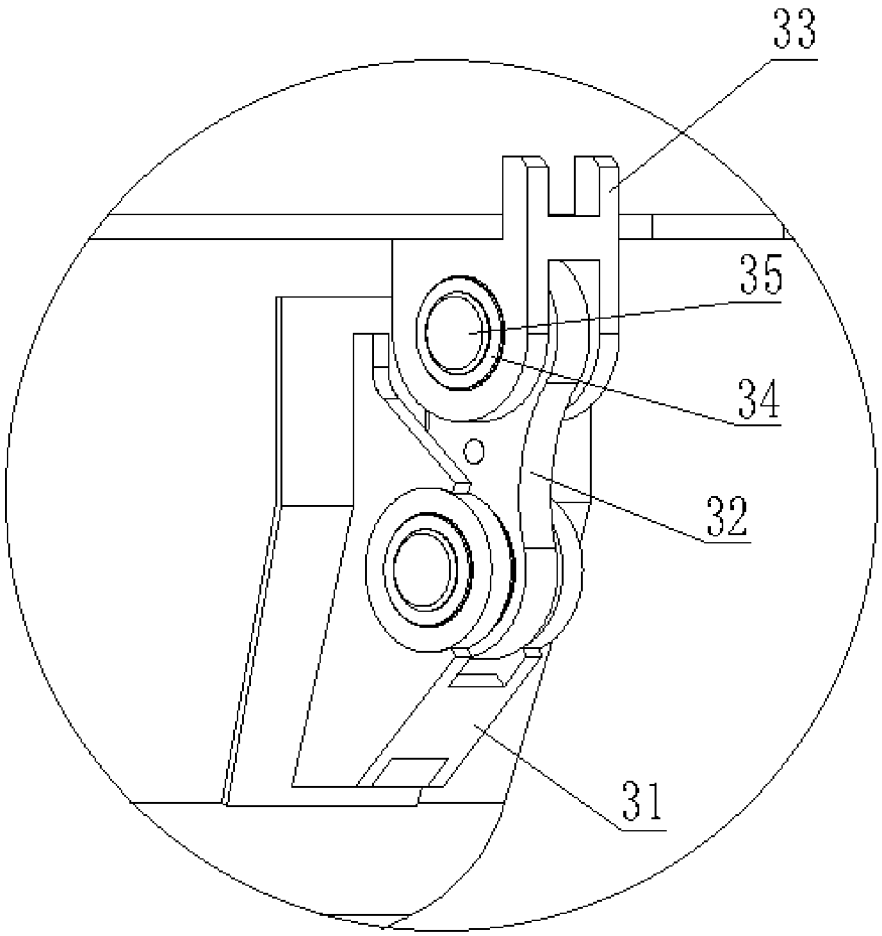
FIG. 4 is a partial enlarged view of the portion indicated by "I" in FIG. 1.

In some embodiments, as shown in FIG. 1 and FIG. 4, the vertical connecting rod mechanism 3 includes a third connecting rod seat 31, a vertical connecting rod 32 and a fourth connecting rod seat 33, the third connecting rod seat 31 is set on the lower half of the furnace body 1 of the converter, the fourth connecting rod seat 33 is set on the lower edge of the backing ring body 2, and the third connecting rod seat 31 and the fourth connecting rod seat 33 are respectively hinged to the vertical connecting rod 32.

In some embodiments, the horizontal connecting rod 42 in each horizontal connecting rod mechanism 4 and the vertical connecting rod 32 in each vertical connecting rod mechanism 3 have the same shape and size, making the horizontal connecting rod 42 and the vertical connecting rod 32 interchangeable, reducing the variety of parts, helping to reduce the cost of equipment spare parts, and making it easier to assemble.

In some embodiments, the first connecting rod seat 41 and the second connecting rod seat 43 are rotatably connected to the horizontal connecting rod 42 via the first joint bearing 44 and the first articulated shaft 45 respectively, and the third connecting rod seat 31 and the fourth connecting rod seat 33 are rotatably connected to the vertical connecting rod 32 via the second joint bearing 34 and the second articulated shaft 35 respectively, the first joint bearing 44 and the second joint bearing 34 have the same structure and size, and the first articulation shaft 45 and the second articulation shaft 35 have the same structure and size. During assembly, the joint bearings and articulated shafts of the horizontal connecting rod mechanism 4 and the vertical connecting rod mechanism 3 structure can also be interchanged, reducing the types of parts, helping to further reduce the cost of equipment spare parts, and further improving the ease of assembly.

In some embodiments, as shown in FIG. 1 to FIG. 2, each horizontal connecting rod mechanism is symmetrically divided on both sides of the first reference plane m and each vertical connecting rod mechanism is symmetrically divided on both sides of the second reference plane n.

The beneficial effects of the present invention are:

(1) Finite element analysis and several practices verify that this hanging structure sets the vertical connecting rod mechanism 3 in a specific angle area (that is, the radiation area of the first included angle $\alpha$), and sets the horizontal connecting rod mechanism 4 above the vertical connecting rod mechanism 3, which not only makes the vertical connecting rod mechanism 3 become the main mechanism to restrain the horizontal connecting rod mechanism 4 in the support surface "alternating misalignment displacement", but also makes both the vertical connecting rod mechanism 3 and the horizontal connecting rod mechanism 4 far away from the maximum position (~15 mm) of the alternating misalignment, and the horizontal connecting rod mechanism 4 is between the furnace body 1 and the backing ring 2, which is in the minimum range (1 mm~2 mm) of the "alternating misalignment displacement". The horizontal the horizontal connecting rod mechanism 4 has a more solid installation base, better working conditions and longer working life to achieve the optimal arrangement of the entire suspension adaptive hanging structure of the converter. The main reason why patent ZL93117357.4 sets the horizontal connecting rod support mechanism at the position close to the lower part of the trunnion backing ring is to direct the force generated by the tilting to the bearing trunnion as far as possible, so that the backing ring can be kept in the stress-free state to the maximum extent, but it ignores that this position is the position where the whole backing ring produces maximum "alternating misalignment" due to the bending and twisting effect and the most unfavorable position for the horizontal connecting rod. In fact, the whole rigidity and strength of the backing ring of the converter and trunnion equipment is much greater than the horizontal connecting rod mechanism, relatively speaking, the rigidity and strength of the horizontal connecting rod mechanism placed here is very weak. Therefore, the best position for the horizontal connecting rod mechanism is between the furnace body of the converter equipment and the backing ring with the small "alternating misalignment displacement".

(2) The pendulum 6 or static guide mechanism 7 in patent ZL93117357.4 and the guide seat used to limit the axial movement of the converter shell along the trunnion during tilting in patent ZL201210291941.6 are removed to simplify the horizontal support mechanism of the converter suspension, eliminating the problem of super static over constraint in the existing hanging structure, facilitating the self-adaptive working conditions of the converter suspension connecting rod mechanism and reducing the equipment maintenance workload.

(3) What's more, compared with the way of only setting the horizontal connecting rod mechanism under each trunnion to form the single-point support in patent ZL93117357.4, the adaptive hanging structure of the converter is more applicable to the working condition of large tonnage converter by using the paired horizontal connecting rod mechanism and vertical connecting rod mechanism to form the two-point support structure on the upper and lower sides of the backing ring.

(4) The invention is a simple, reliable suspension hanging system with perfect and optimal static design between the backing ring and the furnace shell. There is flexible and strong connection between the backing ring and the furnace shell that uniform load is distributed on each connecting rod which has self-adaptive capability to compensate for thermal deformation to cope with harsh environments with high mechanical and thermal loads.

(5) The main parts of the vertical connecting rod mechanism 3 and horizontal connecting rod mechanism 4 in the hanging structure such as vertical connecting rod 32, horizontal connecting rod 42, joint bearings 34, 44 and articulated shaft 35, 45, etc. are interchangeable, which greatly reduces the variety of spare parts, equipment maintenance costs and equipment maintenance time.

(6) Compared with the way of blocking seat mechanism, the connecting rod mechanism does not require adjustment. In the hanging structure of the present invention, both the horizontal connecting rod mechanism and the vertical connecting rod mechanism have the ability of adaptive action and are insensitive to the environment of lack of grease lubrication, and the tilting operation of the converter does not produce strange abnormal noise and has a longer working life, making the equipment maintenance-free for a long time.

The above descriptions are only examples of the invention, and are not used to limit the protection scope of the invention. For those skilled in the art, the application can have various modifications and changes. Any modification, equivalent replacement, improvement, etc. made within the spirit and principle of this invention shall be included in the protection scope of this invention.

The invention claimed is:

1. A self-adaptive hanging structure of a converter, comprising:

a plurality of vertical connecting rod mechanisms connecting a lower edge of a backing ring body and a lower half furnace body of the converter; and a plurality of horizontal connecting rod mechanisms connecting an upper edge of the backing ring body and an upper half furnace body of the converter;

wherein each of the horizontal connecting rod mechanisms is positioned above a corresponding one of the vertical connecting rod mechanisms;

wherein a plane defined by an axis of a trunnion on the backing ring body and an axis of the backing ring body serves as a first reference plane;

wherein a symmetric center of each of the vertical connecting rod mechanisms is located within a sector defined by a first included angle; two planes forming the first included angle pass through an axis of the backing ring body; included angles of 15° and 50° are formed between the two planes and the first reference plane, respectfully; each vertical connecting rod mechanism is symmetrically arranged about the first reference plane, and each horizontal connecting rod mechanism is symmetrically arranged about the first reference plane;

wherein the horizontal connecting rod mechanism comprises a first connecting rod seat, a horizontal connecting rod and a second connecting rod seat; the first connecting rod seat is disposed on the upper half of the furnace body, and the second connecting rod seat is disposed on the upper edge of the backing ring body; the horizontal connecting rod is hinged to the first connecting rod seat and the second connecting rod seat, respectively;

wherein the horizontal connecting rod mechanism further comprises a mounting position reference mark, located within a sector defined by a second included angle; a plane defined by the axis of the backing ring body and the center of symmetry of the vertical connecting rod mechanism serves as a second reference plane; and the mounting position reference mark is positioned within the sector defined by the second included angle, wherein two planes forming the second included angle pass through the axis of the backing ring body and form included angles of −10° and 10°, respectively, with the second reference plane.

2. The structure of claim 1, wherein the center of symmetry of each vertical connecting rod mechanism is coplanar with the axis of the backing ring body.

3. The structure of claim 2, wherein the mounting position reference mark is on the horizontal connecting rod.

4. The structure of claim 3, wherein the mounting position reference mark is at the center of the horizontal connecting rod.

5. The structure of claim 4, wherein the mounting position reference mark is an identification hole set on the horizontal connecting rod.

6. The structure of claim 2, wherein the vertical connecting rod mechanism comprises a third connecting rod seat, a vertical connecting rod and a fourth connecting rod seat; the third connecting rod seat sets on the lower half of the converter body, and the fourth connecting rod seat sets on the lower edge of the backing ring body; the third connecting rod seat and the fourth connecting rod seat are hinged to the vertical connecting rod respectively.

7. The structure of claim 6, wherein the horizontal connecting rod in each of the horizontal connecting rod mechanisms has the same shape and size as the vertical connecting rod in each of the vertical connecting rod mechanisms.

8. The structure of claim 7, wherein the first connecting rod seat and the second connecting rod seat are respectively rotatably connected to the horizontal connecting rod by means of a first joint bearing and a first articulated shaft, and the third connecting rod seat and the fourth connecting rod seat are respectively rotatably connected to the vertical connecting rod by means of a second joint bearing and a second articulated shaft; the first joint bearing and the second joint bearing have the same structure and size, and the first articulated shaft and the second articulated shaft have the same structure and size.

* * * * *